US009068135B1

(12) United States Patent
Yang et al.

(10) Patent No.: US 9,068,135 B1
(45) Date of Patent: Jun. 30, 2015

(54) LUBRICATING OIL COMPOSITION AND ADDITIVE THEREFOR HAVING IMPROVED PISTON DEPOSIT CONTROL AND EMULSION STABILITY

(71) Applicant: AFTON CHEMICAL CORPORATION, Richmond, VA (US)

(72) Inventors: Kongsheng Yang, Glen Allen, VA (US); William Y. Lam, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 5 days.

(21) Appl. No.: 14/190,130

(22) Filed: Feb. 26, 2014

(51) Int. Cl.

| | |
|---|---|
| ***C10M 141/12*** | (2006.01) |
| ***C10M 159/12*** | (2006.01) |
| ***C10M 135/18*** | (2006.01) |
| ***C10M 133/16*** | (2006.01) |

(52) U.S. Cl.
CPC ..... *C10M 135/18* (2013.01); *C10M 133/16* (2013.01)

(58) Field of Classification Search
CPC ..... C10M 141/12; C10M 159/12; C10N 2230/04; C10N 2230/24; C10N 2240/10
USPC ..... 508/221, 232, 454
See application file for complete search history.

(56) References Cited

U.S. PATENT DOCUMENTS

| | | | | |
|---|---|---|---|---|
| 4,234,435 | A | | 11/1980 | Meinhardt et al. |
| 4,259,194 | A | | 3/1981 | DeVries et al. |
| 4,259,195 | A | | 3/1981 | King et al. |
| 4,261,843 | A | | 4/1981 | King et al. |
| 4,263,152 | A | | 4/1981 | King et al. |
| 4,265,773 | A | | 5/1981 | DeVries et al. |
| 4,272,387 | A | | 6/1981 | King et al. |
| 4,283,295 | A | | 8/1981 | DeVries et al. |
| 4,285,822 | A | | 8/1981 | DeVries et al. |
| 4,636,322 | A | | 1/1987 | Nalesnik |
| 4,702,850 | A | | 10/1987 | Gutierrez et al. |
| 4,867,890 | A | | 9/1989 | Colclough et al. |
| 4,943,672 | A | | 7/1990 | Hamner et al. |
| 5,069,684 | A | * | 12/1991 | Blain et al. ..... 44/331 |
| 5,882,505 | A | | 3/1999 | Wittenbrink et al. |
| 6,013,171 | A | | 1/2000 | Cook et al. |
| 6,080,301 | A | | 6/2000 | Berlowitz et al. |
| 6,096,940 | A | | 8/2000 | Wittenbrink et al. |
| 6,103,099 | A | | 8/2000 | Wittenbrink et al. |
| 6,165,949 | A | | 12/2000 | Berlowitz et al. |
| 6,180,575 | B1 | | 1/2001 | Nipe |
| 6,300,291 | B1 | | 10/2001 | Hartley et al. |
| 6,548,458 | B2 | | 4/2003 | Loper |
| 6,723,685 | B2 | | 4/2004 | Hartley et al. |
| 7,026,273 | B2 | * | 4/2006 | Robson et al. ..... 508/156 |
| 7,214,649 | B2 | | 5/2007 | Loper et al. |
| 7,645,726 | B2 | | 1/2010 | Loper |
| 7,776,800 | B2 | * | 8/2010 | Lam et al. ..... 508/165 |
| 8,048,831 | B2 | | 11/2011 | Loper |
| 2002/0038525 | A1 | | 4/2002 | Callis et al. |
| 2004/0266630 | A1 | | 12/2004 | George et al. |
| 2010/0160192 | A1 | * | 6/2010 | Ruhe, Jr. ..... 508/287 |
| 2010/0160194 | A1 | * | 6/2010 | Harrison et al. ..... 508/290 |
| 2012/0145115 | A1 | * | 6/2012 | Nelson et al. ..... 123/196 R |
| 2012/0180382 | A1 | * | 7/2012 | Fang et al. ..... 44/342 |
| 2013/0040866 | A1 | * | 2/2013 | Mathur et al. ..... 508/306 |
| 2013/0085235 | A1 | * | 4/2013 | Harrison et al. ..... 525/382 |
| 2014/0106998 | A1 | * | 4/2014 | Nelson et al. ..... 508/186 |
| 2014/0106999 | A1 | * | 4/2014 | Nelson et al. ..... 508/186 |

* cited by examiner

*Primary Examiner* — Ellen McAvoy
(74) *Attorney, Agent, or Firm* — Luedeka Neely Group, P.C.

(57) ABSTRACT

A lubricant additive composition, a method for reducing engine deposit formation and a method for improving emulsion stability of a lubricant composition. The lubricant additive composition includes (a) an organomolybdenum compound contributing from about 20 to no greater than 300 ppm by weight molybdenum to the lubricant composition based on a total weight of the lubricant composition containing the additive composition; (b) a boronated hydrocarbyl substituted succinimide dispersant; and (c) a reaction product of (i) a hydrocarbyl-dicarboxylic acid or anhydride, (ii) a polyamine, (iii) a dicarboxyl-containing fused aromatic compound, and (iv) a non-aromatic dicarboxylic acid or anhydride. The hydocarbyl group of the hydrocarbyl-dicarboxylic acid or anhydride has a number average molecular weight of greater than 1800 Daltons as determined by gel permeation chromatography. A weight ratio of (b) to (c) ranges from about 1:1 to about 4:1.

21 Claims, No Drawings

LUBRICATING OIL COMPOSITION AND ADDITIVE THEREFOR HAVING IMPROVED PISTON DEPOSIT CONTROL AND EMULSION STABILITY

TECHNICAL FIELD

The disclosure relates to lubricant compositions and in particular to additives for improving the deposit control characteristics and/or emulsion stability properties of an engine lubricant composition.

BACKGROUND AND SUMMARY

A lubricating oil composition for engine oil applications often has to meet certain performance requirements as stipulated in specifications established by the industry and/or original equipment manufacturers (OEMs). In general, engine oils have to provide adequate levels of oxidation and wear protection, sludge and deposit formation control, fuel economy benefits, compatibility with sealing materials, and other desirable physical and rheological characteristics that are essential for lubrication and serviceability, as determined by various standardized engine and bench tests. For example, ASTM Sequence IIIG test is one of the required engine tests in ILSAC GF-4/API SM, ILSAC GF-5/API SN and GM Dexosl™ specifications, with its minimum weighted piston deposit (WPD) cleanliness merit rating of 3.5, 4.0 and 4.5, respectively. Hence continual improvement in WPD performance is likely one of many desirable features for engine lubricating oils to achieve for future specifications. Similarly, a desire for enhanced fuel economy performance of engine oils may necessitate an increase in friction modifier usage level that has been known to impact negatively on the ability of the lubricant composition to maintain stable emulsions as determined by mixing water and E85 fuel in the ASTM D7563 Emulsion Retention Test.

Accordingly, there remains a need for improved lubricant additive compositions that can provide improved piston deposit control as well as improved emulsion stability and that are suitable for meeting or exceeding currently proposed and future lubricant performance standards.

With regard to the foregoing, embodiments of the disclosure provide a lubricant additive composition, a method for reducing engine deposit formation and a method for improving emulsion stability of a lubricant composition. The lubricant additive composition includes (a) an organomolybdenum compound contributing from about 50 to about 300 ppm by weight molybdenum to a lubricant composition based on a total weight of the lubricant composition containing the additive composition; (b) a boronated hydrocarbyl substituted succinimide dispersant; and (c) a reaction product of (i) a hydrocarbyl-dicarboxylic acid or anhydride, (ii) a polyamine, (iii) a dicarboxyl-containing fused aromatic compound, and (iv) a non-aromatic dicarboxylic acid or anhydride. The hydocarbyl group of the hydrocarbyl-dicarboxylic acid or anhydride has a number average molecular weight of greater than 1800 Daltons as determined by gel permeation chromatography. A weight ratio of (b) to (c) ranges from about 1:1 to about 4:1.

Another embodiment of the disclosure provides a method for controlling piston depositions in an engine. The method includes lubricating the engine with a lubricant composition that includes a base oil of lubricating viscosity and an additive composition that includes: (a) an organomolybdenum compound contributing from about 50 to about 300 ppm by weight of molybdenum to the lubricant composition based on a total weight of the lubricant composition; (b) a boronated hydrocarbyl substituted succinimide dispersant; and (c) a reaction product of (i) a hydrocarbyl-dicarboxylic acid or anhydride, (ii) a polyamine, (iii) a dicarboxyl-containing fused aromatic compound, and (iv) a non-aromatic dicarboxylic acid or anhydride. The hydocarbyl group of the hydrocarbyl-dicarboxylic acid or anhydride has a number average molecular weight of greater than 1800 Daltons as determined by gel permeation chromatography. A weight ratio of (b) to (c) ranges from about 1:1 to about 4:1.

A further embodiment of the disclosure provides a method for maintaining an emulsion stability of an engine lubricant composition. The method includes lubricating the engine with a lubricant composition that includes a base oil of lubricating viscosity and a lubricant additive composition that contains: (a) an organomolybdenum compound contributing from about 50 to about 300 ppm by weight of molybdenum to the lubricant composition based on a total weight of the lubricant composition; (b) a boronated hydrocarbyl substituted succinimide dispersant; and (c) a reaction product of (i) a hydrocarbyl-dicarboxylic acid or anhydride, (ii) a polyamine, (iii) a dicarboxyl-containing fused aromatic compound, and (iv) a non-aromatic dicarboxylic acid or anhydride. The hydocarbyl group of the hydrocarbyl-dicarboxylic acid or anhydride has a number average molecular weight of greater than 1800 Daltons as determined by gel permeation chromatography. A weight ratio of (b) to (c) ranges from about 1:1 to about 4:1.

An unexpected advantage of the use of the dispersant additive composition of the disclosed embodiments is that the composition not only provides improved engine deposit control, it also enables an increase in metal containing friction modifiers without adversely affecting the emulsion stability of the lubricant composition.

The following definitions of terms are provided in order to clarify the meanings of certain terms as used herein.

As used herein, the terms "oil composition," "lubrication composition," "lubricating oil composition," "lubricating oil," "lubricant composition," "lubricating composition," "fully formulated lubricant composition," and "lubricant" are considered synonymous, fully interchangeable terminology referring to the finished lubrication product comprising a major amount of a base oil plus a minor amount of an additive composition.

As used herein, the terms "additive package," "additive concentrate," and "additive composition" are considered synonymous, fully interchangeable terminology referring the portion of the lubricating composition excluding the major amount of base oil stock mixture.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents such as pyridyl, furyl, thienyl, and imidazolyl. In general, no more than two, for example, no more than one, non-hydrocarbon substituent will be present for every ten carbon atoms in the hydrocarbyl group; typically, there will be no non-hydrocarbon substituents in the hydrocarbyl group.

As used herein, the term "percent by weight", unless expressly stated otherwise, means the percentage the recited component represents to the weight of the entire composition.

The terms "oil-soluble" or "dispersible" used herein may but do not necessarily indicate that the compounds or additives are soluble, dissolvable, miscible, or capable of being suspended in the oil in all proportions. The foregoing terms do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

Lubricating oils, engine lubricating oils, and/or crankcase lubricating oils of the present disclosure may be formulated by the addition of one or more additives, as described in detail below, to an appropriate base oil formulation. The additives may be combined with a base oil in the form of an additive package (or concentrate) or, alternatively, may be combined individually with a base oil. The fully formulated lubricant, engine lubricant, and/or crankcase lubricant may exhibit improved performance properties, based on the additives added and their respective proportions.

Additional details and advantages of the disclosure will be set forth in part in the description which follows, and/or may be learned by practice of the disclosure. The details and advantages of the disclosure may be realized and attained by means of the elements and combinations particularly pointed out in the appended claims.

It is to be understood that both the foregoing general description and the following detailed description are exemplary and explanatory only and are not restrictive of the disclosure, as claimed.

DESCRIPTION OF THE EXEMPLARY EMBODIMENTS

The present disclosure will now be described in the more limited aspects of embodiments thereof, including various examples of the formulation and use of the present disclosure. It will be understood that these embodiments are presented solely for the purpose of illustrating the invention and shall not be considered as a limitation upon the scope thereof.

Engine or crankcase lubricant compositions are used in vehicles containing spark ignition and compression ignition engines. Such engines may be used in automotive, truck, and/or train applications and may be operated on fuels including, but not limited to, gasoline, diesel, alcohol, compressed natural gas, and the like. The disclosure may describe lubricants suitable for use as engine lubricants, such as automotive crankcase lubricants that meet or exceed the ILSAC GF-5 and/or API CJ-4 lubricant standards.

Base Oil

Base oils suitable for use in formulating engine lubricant compositions may be selected from any of suitable synthetic oils, animal oils, vegetable oils, mineral oils or mixtures thereof. Animal oils and vegetable oils (e.g., lard oil, castor oil) as well as mineral lubricating oils such as liquid petroleum oils and solvent treated or acid-treated mineral lubricating oils of the paraffinic, naphthenic or mixed paraffinic-naphthenic types may be used. Oils derived from coal or shale may also be suitable. The base oil typically may have a viscosity of about 2 to about 15 cSt or, as a further example, about 2 to about 10 cSt at 100° C. Further, an oil derived from a gas-to-liquid process is also suitable.

Suitable synthetic base oils may include alkyl esters of dicarboxylic acids, polyglycols and alcohols, poly-alpha-olefins, including polybutenes, alkyl benzenes, organic esters of phosphoric acids, and polysilicone oils. Synthetic oils include hydrocarbon oils such as polymerized and interpolymerized olefins (e.g., polybutylenes, polypropylenes, propylene isobutylene copolymers, etc.); poly(1-hexenes), poly-(1-octenes), poly(1-decenes), etc. and mixtures thereof; alkylbenzenes (e.g., dodecylbenzenes, tetradecylbenzenes, di-nonylbenzenes, di-(2-ethylhexyl)benzenes, etc.); polyphenyls (e.g., biphenyls, terphenyl, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic oils that may be used. Such oils are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example, the acetic acid esters, mixed $C_3$-$C_8$ fatty acid esters, or the $C_{13}$ oxo-acid diester of tetraethylene glycol.

Another class of synthetic oils that may be used includes the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Hence, the base oil used which may be used to make the engine lubricant compositions as described herein may be selected from any of the base oils in Groups I-V as specified in the American Petroleum Institute (API) Base Oil Interchangeability Guidelines. Such base oil groups are as follows:

TABLE 1

| Base Oil Group[1] | Sulfur (wt %) | | Saturates (wt. %) | Viscosity Index |
|---|---|---|---|---|
| Group I | >0.03 | And/or | <90 | 80 to 120 |
| Group II | ≤0.03 | And | ≥90 | 80 to 120 |
| Group III | ≤0.03 | And | ≥90 | ≥120 |
| Group IV | all polyalphaolefins (PAOs) | | | |
| Group V | all others not included in Groups I-IV | | | |

[1]Groups I-III are mineral oil base stocks.

The base oil may contain a minor or major amount of a poly-alpha-olefin (PAO). Typically, the poly-alpha-olefins are derived from monomers having from about 4 to about 30, or from about 4 to about 20, or from about 6 to about 16 carbon atoms. Examples of useful PAOs include those derived from octene, decene, mixtures thereof, and the like. PAOs may have a viscosity of from about 2 to about 15, or from about 3 to about 12, or from about 4 to about 8 cSt at 100° C. Examples of PAOs include 4 cSt at 100° C. poly-alpha-olefins, 6 cSt at 100° C. poly-alpha-olefins, and mixtures thereof. Mixtures of mineral oil with the foregoing poly-alpha-olefins may be used.

The base oil may be an oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized using processes disclosed in U.S. Pat. Nos. 6,103,099 or 6,180,575; hydrocracked and hydroisomerized using processes disclosed in U.S. Pat. Nos. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949.

Unrefined, refined, and rerefined oils, either natural or synthetic (as well as mixtures of two or more of any of these) of the type disclosed hereinabove can be used in the base oils. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives, contaminants, and oil breakdown products.

The base oil may be combined with an additive composition as disclosed in embodiments herein to provide an engine lubricant composition. Accordingly, the base oil may be present in the engine lubricant composition in an amount ranging from about 50 wt. % to about 95 wt. % based on a total weight of the lubricant composition.

Dispersant Additive Composition

In an aspect of the disclosed embodiments, the methods and composition include the use of a dispersant additive composition that includes at least two hydrocarbyl dispersants. A first hydrocarbyl dispersant is a conventional succinimide dispersant derived from a hydrocarbyl succinic acid or anhydride and an amine. Such conventional succinimide dispersants may be represented by the following formulas (I) and (II):

I

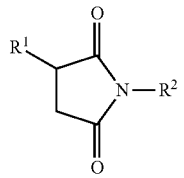

II

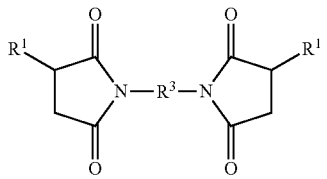

and mixtures thereof, wherein $R^1$ is a hydrocarbyl substituent is derived from a polyolefin having a number average molecular weight ranging from about 1000 to about 1600 Daltons as determined by gel permeation chromatography. A particularly suitable hydrocarbyl substituent is a compound derived from polypropene or polybutene having a number average molecular weight ranging from about 1200 to about 1400 Daltons. In one embodiment, $R^1$ is derived from a polybutene having greater than 50 mole percent terminal vinylidene groups. $R^2$ is selected from H, —$(CH_2)_m$H, and $$-((CH_2)_m\overset{\overset{R^4}{|}}{C}HNH)_nH);$$

$R^3$ is $$-((CH_2)_m\overset{\overset{R^4}{|}}{C}HNH)_n\overset{\overset{R^4}{|}}{C}H(CH_2)_m;$$

and $R^4$ is selected from hydrogen and —$(CH_3)$, wherein m is an integer ranging from 1 to 3, n is an integer ranging from 1 to 10. Methods for making conventional succinimide dispersants according to the above formulas are well known in the art and are described, for example U.S. Pat. Nos. 4,234,435 and 4,636,322. Such dispersants typically have a molar ratio of hydrocarbyl group (R') to dicarboxylic acid or anhydride moiety ranging from about 1:1 to about 3:1. Such dispersants may also be post-treated by conventional methods by a reaction with any of a variety of agents. Among such post-treating agents boron, urea, thiourea, dimercaptothidiazoles, carbon disulfide, alkdehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference A particularly suitable conventional succinimide dispersant includes a boronated dispersant having a nitrogen content ranging from about 1 wt. % to about 2.5 wt. %, such as from about 1.2 wt. % to about 2.0 wt. %, and desirably from about 1.4 wt. % to about 1.7 wt. % and a boron to nitrogen weight ratio ranging from about 0.1:1 to about 1:1, such as from about 0.2:1 to about 0.8:1 and particularly from about 0.4:1 to about 0.55:1.

Functionalized Dispersant

The second dispersant of the dispersant additive composition is a functionalized dispersant. The functionalized dispersant is a reaction product of A) a hydrocarbyl-dicarboxylic acid or anhydride, B) a polyamine, C) a dicarboxyl-containing fused aromatic compound, and D) a non-aromatic dicarboxylic acid or anhydride. A suitable functionalized dispersant is described in U.S. Publication No. 2013/0040866, incorporated herein by reference.

Component A

The hydrocarbyl moiety of the hydrocarbyl-dicarboxylic acid or anhydride of Component A may be derived from butene polymers, for example polymers of isobutylene. Suitable polyisobutenes for use herein include those formed from polyisobutylene or highly reactive polyisobutylene having at least about 50 mole %, such as about 60 mole %, and particularly from about 70 mole % to about 90 mole % and above, terminal vinylidene content. Suitable polyisobutenes may include those prepared using $BF_3$ catalysts. The average number molecular weight of the polyalkenyl substituent may vary over a wide range, for example from about 100 to about 5000, such as from about 500 to about 5000, as determined by GPC using polystyrene as a calibration reference as described above.

The dicarboxylic acid or anhydride of Component A may be selected from maleic anhydride or from carboxylic reactants other than maleic anhydride, such as maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters. A suitable dicarboxylic anhydride is maleic anhydride. A mole ratio of maleic anhydride to hydrocarbyl moiety in a reaction mixture used to make Component A may vary widely. Accordingly, the mole ratio may vary from about 5:1 to about 1:5, for example from about 3:1 to about 1:3, and as a further example, the maleic anhydride may be used in excess to force the reaction to completion. The unreacted maleic anhydride may be removed by vacuum distillation.

Component B

Any of numerous polyamines can be used as Component B in preparing the functionalized dispersant. Non-limiting exemplary polyamines may include aminoguanidine bicarbonate (AGBC), diethylene triamine (DETA), triethylene tetramine (TETA), tetraethylene pentamine (TEPA), pentaethylene hexamine (PEHA) and heavy polyamines. A heavy polyamine may comprise a mixture of polyalkylenepolyamines having small amounts of lower polyamine oligomers such as TEPA and PEHA, but primarily oligomers having seven or more nitrogen atoms, two or more primary amines per molecule, and more extensive branching than conventional polyamine mixtures. Additional non-limiting polyamines which may be used to prepare the hydrocarbyl-substituted succinimide dispersant are disclosed in U.S. Pat. No. 6,548,458, the disclosure of which is incorporated herein by reference in its entirety. In an embodiment of the disclosure, the polyamine may be selected from tetraethylene pentamine (TEPA).

In an embodiment, the functionalized dispersant may be derived from compounds of formula (I):

(I)

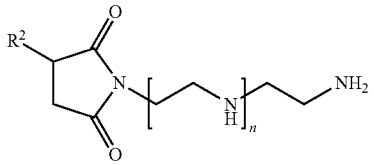

wherein n represents 0 or an integer of from 1 to 5, and $R^2$ is a hydrocarbyl substituent as defined above. In an embodiment, n is 3 and $R^2$ is a polyisobutenyl substituent, such as that derived from polyisobutylenes having at least about 50 mole %, such as about 60 mole %, such as about 70 mole % to about 90 mole % and above, terminal vinylidene content. Compounds of formula (I) may be the reaction product of a hydrocarbyl-substituted succinic anhydride, such as a polyisobutenyl succinic anhydride (PIBSA), and a polyamine, for example tetraethylene pentamine (TEPA).

The foregoing compound of formula (I) may have a molar ratio of (A) polyisobutenyl-substituted succinic anhydride to (B) polyamine in the range of about 1:1 to about 10:1 in the compound. A particularly useful dispersant contains polyisobutenyl group of the polyisobutenyl-substituted succinic anhydride having a number average molecular weight (Mn) in the range of from about 500 to 5000 as determined by GPC using polystyrene as a calibration reference and a (B) polyamine having a general formula $H_2N(CH_2)m\text{-}[NH(CH_2)_m]_n—NH_2$, wherein m is in the range from 2 to 4 and n is in the range of from 1 to 2.

Component C

Component C is a carboxyl or polycarboxyl acid or polyanhydride wherein the carboxyl acid or anhydride functionalities are directly fused to an aromatic group. Such carboxyl-containing aromatic compound may be selected from 1,8-naphthalic acid or anhydride and 1,2-naphthalenedicarboxylic acid or anhydride, 2,3-dicaroxylic acid or anhydride, naphthalene-1,4-dicarboxylic acid, naphthalene-2,6-dicarboxylic acid, phthalic anhydride, pyromellitic anhydride, 1,2,4-benzene tricarboxylic acid anhydride, diphenic acid or anhydride, 2,3-pyridine dicarboxylic acid or anhydride, 3,4-pyridine dicarboxylic acid or anhydride, 1,4, 58-naphthalenetetracarboxylic acid or anhydride, perylene-3,4,9,10-tetracarboxylic anhydride, pyrene dicarboxlic acid or anhydride, and alike. The moles of Component C reacted per mole of Component B may range from about 0.1:1 to about 2:1. A typical molar ratio of component C to Component B in the reaction mixture may range from about 0.2:1 to about 2.0:1. Another molar ratio of Component C to Component B that may be used may range from 0.25:1 to about 1.5:1. Component C may be reacted with the other components at a temperature ranging from about 140° to about 180° C.

Component D

Component D is a non-aromatic carboxylic acid or anhydride. Suitable carboxylic acids or anhydrides thereof may include, but are not limited to acetic acid or anhydride, oxalic acid and anhydride, malonic acid and anhydride, succinic acid and anhydride, alkenyl succinic acid or anhydride, glutaric acid an anhydride, adipic acid and anhydride, pimelic acid and anhydride, suberic acid and anhydride, azelaic acid and anhydride, sebacic acid and anhydride, maleic acid and anhydride, fumaric acid and anhydride, tartaric acid or anhydride, glycolic acid or anhydride, 1,2,3,6-tetrahydronaphthalic acid or anhydride, and the like. Component D is reacted on a molar ratio with Component B ranging from about 0.1 to about 2.5 moles of Component D per mole of Component B reacted. Typically, the amount of Component D used will be relative to the number of secondary amino groups in Component B. Accordingly, from about 0.2 to about 2.0 moles of Component D per secondary amino group in Component B may be reacted with the other components to provide the dispersant according to embodiments of the disclosure. Another molar ratio of Component D to component B that may be used may range from 0.25:1 to about 1.5:1 moles of Component D per mole of Component B. Component D may be reacted with the other components at a temperature ranging from about 140° to about 180° C.

The dispersant additive composition may contain a dispersant mixture having a weight ratio of (b) to (c) ranging from about 1:1 to about 4:1, such as from about 1.5:1 to about 3:1, particularly from about 1.8:1 to about 2.2:1. Accordingly, a lubricant composition as described herein may contain from about 0.5 wt. % to about 10.0 wt. % of the dispersant additive composition described above based on a total weight of the lubricant composition. A typical range of dispersant additive composition may be from about 2 wt. % to about 6 wt. % based on a total weight of the lubricant composition. In addition to the foregoing dispersant additive composition, the lubricant composition may include other conventional ingredients, including but not limited to, friction modifiers, metal detergents, antiwear agents, antifoam agents, antioxidants, viscosity modifiers, pour point depressants, corrosion inhibitors and the like.

Metal-Containing Detergents

Metal detergents that may be used with the dispersant reaction product described above generally comprise a polar head with a long hydrophobic tail where the polar head comprises a metal salt of an acidic organic compound. The salts may contain a substantially stoichiometric amount of the metal, in which case they are usually described as normal or neutral salts, and would typically have a total base number or TBN (as measured by ASTM D2896) of from about 0 to less than about 150. Large amounts of a metal base may be included by reacting an excess of a metal compound such as an oxide or hydroxide with an acidic gas such as carbon dioxide. The resulting overbased detergent comprises micelles of neutralized detergent surrounding a core of inorganic metal base (e.g., hydrated carbonates). Such overbased detergents may have a TBN of about 150 or greater, such as from about 150 to about 450 or more.

Detergents that may be suitable for use in the present embodiments include oil-soluble overbased, low base, and neutral sulfonates, phenates, sulfurized phenates, and salicylates of a metal, particularly the alkali or alkaline earth metals, e.g., sodium, potassium, lithium, calcium, and magnesium. More than one metal may be present, for example, both calcium and magnesium. Mixtures of calcium and/or magnesium with sodium may also be suitable. Suitable metal detergents may be overbased calcium or magnesium sulfonates having a TBN of from 150 to 450 TBN, overbased calcium or magnesium phenates or sulfurized phenates having a TBN of from 150 to 300 TBN, and overbased calcium or magnesium salicylates having a TBN of from 130 to 350. Mixtures of such salts may also be used.

The metal-containing detergent may be present in a lubricating composition in an amount of from about 0.5 wt % to about 5 wt %. As a further example, the metal-containing detergent may be present in an amount of from about 1.0 wt % to about 3.0 wt %. The metal-containing detergent may be present in a lubricating composition in an amount sufficient to provide from about 500 to about 5000 ppm alkali and/or alkaline earth metal to the lubricant composition based on a total weight of the lubricant composition. As a further example, the metal-containing detergent may be present in a lubricating composition in an amount sufficient to provide from about 1000 to about 3000 ppm alkali and/or alkaline earth metal.

Phosphorus-Based Antiwear Agents

Phosphorus-based wear preventative agents may be used and may comprise a metal dihydrocarbyl dithiophosphate compound, such as but not limited to a zinc dihydrocarbyl dithiophosphate compound. Suitable metal dihydrocarbyl dithiophosphates may comprise dihydrocarbyl dithiophosphate metal salts wherein the metal may be an alkali or alkaline earth metal, or aluminum, lead, tin, molybdenum, manganese, nickel, copper, or zinc.

Dihydrocarbyl dithiophosphate metal salts may be prepared in accordance with known techniques by first forming a dihydrocarbyl dithiophosphoric acid (DDPA), usually by reaction of one or more alcohol or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

The zinc dihydrocarbyl dithiophosphates (ZDDP) are oil soluble salts of dihydrocarbyl dithiophosphoric acids and may be represented by the following formula:

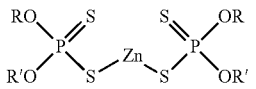

wherein R and R' may be the same or different hydrocarbyl radicals containing from 1 to 18, for example 2 to 12, carbon atoms and including radicals such as alkyl, alkenyl, aryl, arylalkyl, alkaryl, and cycloaliphatic radicals. R and R' groups may be alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e., R and R') in the dithiophosphoric acid will generally be about 5 or greater. The zinc dihydrocarbyl dithiophosphate can therefore comprise zinc dialkyl dithiophosphates.

Other suitable components that may be utilized as the phosphorus-based wear preventative include any suitable organophosphorus compound, such as but not limited to, phosphates, thiophosphates, di-thiophosphates, phosphites, and salts thereof and phosphonates. Suitable examples are tricresyl phosphate (TCP), di-alkyl phosphite (e.g., dibutyl hydrogen phosphite), and amyl acid phosphate.

Another suitable component is a phosphorylated succinimide such as a completed reaction product from a reaction between a hydrocarbyl substituted succinic acylating agent and a polyamine combined with a phosphorus source, such as inorganic or organic phosphorus acid or ester. Further, it may comprise compounds wherein the product may have amide, amidine, and/or salt linkages in addition to the imide linkage of the type that results from the reaction of a primary amino group and an anhydride moiety.

The phosphorus-based wear preventative may be present in a lubricating composition in an amount sufficient to provide from about 200 to about 2000 ppm phosphorus. As a further example, the phosphorus-based wear preventative may be present in a lubricating composition in an amount sufficient to provide from about 500 to about 800 ppm phosphorus.

The phosphorus-based wear preventative may be present in a lubricating composition in an amount sufficient to provide a ratio of alkali and/or alkaline earth metal content (ppm) based on the total amount of alkali and/or alkaline earth metal in the lubricating composition to phosphorus content (ppm) based on the total amount of phosphorus in the lubricating composition of from about 1.6 to about 3.0 (ppm/ppm).

Friction Modifiers

Embodiments of the present disclosure may include one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, and the like.

Suitable friction modifiers may contain hydrocarbyl groups that are selected from straight chain, branched chain, or aromatic hydrocarbyl groups or admixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms and may be saturated or unsaturated.

Aminic friction modifiers may include amides of polyamines. Such compounds can have hydrocarbyl groups that are linear, either saturated or unsaturated, or a mixture thereof and may contain from about 12 to about 25 carbon atoms.

Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference.

Other suitable friction modifiers may include an organic, ashless (metal-free), nitrogen-free organic friction modifier. Such friction modifiers may include esters formed by reacting carboxylic acids and anhydrides with alkanols. Other useful friction modifiers generally include a polar terminal group (e.g. carboxyl or hydroxyl) covalently bonded to an oleophilic hydrocarbon chain. Esters of carboxylic acids and anhydrides with alkanols are described in U.S. Pat. No. 4,702,850. Another example of an organic ashless nitrogen-free friction modifier is known generally as glycerol monooleate (GMO) which may contain mono- and diesters of oleic acid. Other suitable friction modifiers are described in U.S. Pat. No. 6,723,685, herein incorporated by reference. The ashless friction modifier may be present in the lubricant composition in an amount ranging from about 0.1 to about 0.4 percent by weight based on a total weight of the lubricant composition.

Suitable friction modifiers may also include one or more molybdenum compounds. The molybdenum compound may be selected from the group consisting of molybdenum dithiocarbamates (MoDTC), molybdenum dithiophosphates, molybdenum dithiophosphinates, molybdenum xanthates, molybdenum thioxanthates, molybdenum sulfides, a trinuclear organo-molybdenum compound, molybdenum/amine complexes, and mixtures thereof.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897.

Suitable molybdenum dithiocarbamates may be represented by the formula:

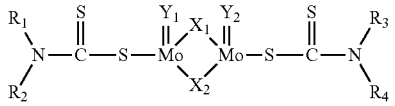

where $R_1$, $R_2$, $R_3$, and $R_4$ each independently represent a hydrogen atom, a $C_1$ to $C_{20}$ alkyl group, a $C_6$ to $C_{20}$ cycloalkyl, aryl, alkylaryl, or aralkyl group, or a $C_3$ to $C_{20}$ hydrocarbyl group containing an ester, ether, alcohol, or carboxyl group; and $X_1$, $X_2$, $Y_1$, and $Y_2$ each independently represent a sulfur or oxygen atom.

Examples of suitable groups for each of $R_1$, $R_2$, $R_3$, and $R_4$ include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl. $R_1$ to $R_4$ may each have $C_6$ to $C_{18}$ alkyl groups. $X_1$ and $X_2$ may be the same, and $Y_1$ and $Y_2$ may be the same. $X_1$ and $X_2$ may both comprise sulfur atoms, and $Y_1$ and $Y_2$ may both comprise oxygen atoms.

Further examples of molybdenum dithiocarbamates include $C_6$-$C_{18}$ dialkyl or diaryldithiocarbamates, or alkylaryldithiocarbamates such as dibutyl-, diamyl-di-(2-ethylhexyl)-, dilauryl-, dioleyl-, and dicyclohexyl-dithiocarbamate.

Another class of suitable organo-molybdenum compounds are trinuclear molybdenum compounds, such as those of the formula $Mo_3S_kL_nQ_z$ and mixtures thereof, wherein L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference.

The molybdenum compound may be present in a fully formulated engine lubricant in an amount to provide about 5 ppm to 500 ppm by weight molybdenum. As a further example, the molybdenum compound may be present in an amount to provide about 50 to 300 ppm by weight molybdenum. A particularly suitable amount of molybdenum compound may be an amount sufficient to provide from about 60 to about 250 ppm by weight molybdenum to the lubricant composition.

Anti-Foam Agents

In some embodiments, a foam inhibitor may form another component suitable for use in the compositions. Foam inhibitors may be selected from silicones, polyacrylates, and the like. The amount of antifoam agent in the engine lubricant formulations described herein may range from about 0.001 wt % to about 0.1 wt % based on the total weight of the formulation. As a further example, antifoam agent may be present in an amount from about 0.004 wt. % to about 0.008 wt. %.

Oxidation Inhibitor Components

Oxidation inhibitors or antioxidants reduce the tendency of base stocks to deteriorate in service which deterioration can be evidenced by the products of oxidation such as sludge and varnish-like deposits that deposit on metal surfaces and by viscosity growth of the finished lubricant. Such oxidation inhibitors include hindered phenols, sulfurized hindered phenols, alkaline earth metal salts of alkylphenolthioesters having $C_5$ to $C_{12}$ alkyl side chains, sulfurized alkylphenols, metal salts of either sulfurized or nonsulfurized alkylphenols, for example calcium nonylphenol sulfide, ashless oil soluble phenates and sulfurized phenates, phosphosulfurized or sulfurized hydrocarbons, phosphorus esters, metal thiocarbamates, and oil soluble copper compounds as described in U.S. Pat. No. 4,867,890.

Other antioxidants that may be used include sterically hindered phenols and esters thereof, diarylamines, alkylated phenothiazines, sulfurized compounds, and ashless dialkyldithiocarbamates. Non-limiting examples of sterically hindered phenols include, but are not limited to, 2,6-di-tertiary butylphenol, 2,6 di-tertiary butyl methylphenol, 4-ethyl-2,6-di-tertiary butylphenol, 4-propyl-2,6-di-tertiary butylphenol, 4-butyl-2,6-di-tertiary butylphenol, 4-pentyl-2,6-di-tertiary butylphenol, 4-hexyl-2,6-di-tertiary butylphenol, 4-heptyl-2,6-di-tertiary butylphenol, 4-(2-ethylhexyl)-2,6-di-tertiary butylphenol, 4-octyl-2,6-di-tertiary butylphenol, 4-nonyl-2,6-di-tertiary butylphenol, 4-decyl-2,6-di-tertiary butylphenol, 4-undecyl-2,6-di-tertiary butylphenol, 4-dodecyl-2,6-di-tertiary butylphenol, methylene bridged sterically hindered phenols including but not limited to 4,4-methylenebis(6-tert-butyl-o-cresol), 4,4-methylenebis(2-tert-amyl-o-cresol), 2,2-methylenebis(4-methyl-6 tert-butylphenol, 4,4-methylenebis(2,6-di-tert-butylphenol) and mixtures thereof as described in U.S Publication No. 2004/0266630.

Diarylamine antioxidants include, but are not limited to diarylamines having the formula:

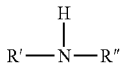

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

The diarylamines may be of a structure containing more than one nitrogen atom in the molecule. Thus the diarylamine may contain at least two nitrogen atoms wherein at least one nitrogen atom has two aryl groups attached thereto, e.g. as in the case of various diamines having a secondary nitrogen atom as well as two aryls on one of the nitrogen atoms.

Examples of diarylamines that may be used include, but are not limited to: diphenylamine; various alkylated diphenylamines; 3-hydroxydiphenylamine; N-phenyl-1,2-phenylenediamine; N-phenyl-1,4-phenylenediamine; monobutyldiphenyl-amine; dibutyldiphenylamine; monooctyldiphenylamine; dioctyldiphenylamine; monononyldiphenylamine; dinonyldiphenylamine; monotetradecyldiphenylamine; ditetradecyldiphenylamine, phenyl-alpha-naphthylamine; monooctyl phenyl-alpha-naphthylamine; phenyl-beta-naphthylamine; monoheptyldiphenylamine; diheptyl-diphenylamine; p-oriented styrenated diphenylamine; mixed butyloctyldi-phenylamine; and mixed octylstyryldiphenylamine.

The sulfur containing antioxidants include, but are not limited to, sulfurized olefins that are characterized by the type of olefin used in their production and the final sulfur content of the antioxidant. High molecular weight olefins, i.e. those olefins having an average molecular weight of 168 to 351 g/mole, are preferred. Examples of olefins that may be used include alpha-olefins, isomerized alpha-olefins, branched olefins, cyclic olefins, and combinations of these.

Alpha-olefins include, but are not limited to, any $C_4$ to $C_{25}$ alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soybean oil, sunflower seed oil, tallow, and combinations of these.

The amount of sulfurized olefin or sulfurized fatty oil delivered to the finished lubricant is based on the sulfur content of the sulfurized olefin or fatty oil and the desired level of sulfur to be delivered to the finished lubricant. For example, a sulfurized fatty oil or olefin containing 20 wt. % sulfur, when added to the finished lubricant at a 1.0 wt. % treat level, will deliver 2000 ppm of sulfur to the finished lubricant. A sulfurized fatty oil or olefin containing 10 wt. % sulfur, when added to the finished lubricant at a 1.0 wt. % treat level, will deliver 1000 ppm sulfur to the finished lubricant. It is desirable that the sulfurized olefin or sulfurized fatty oil to deliver between 200 ppm and 2000 ppm sulfur to the finished lubricant.

In general terms, a suitable engine lubricant may include additive components in the ranges listed in the following

TABLE 2

| Component | Wt. % (Broad) | Wt. % (Typical) |
|---|---|---|
| Dispersant (Reaction product of Components A, B, C, and D) | 0.5-10.0 | 1.0-5.0 |
| Additional Dispersants | 0-10% | 1.0-6.0% |
| Antioxidants | 0-5.0 | 0.01-3.0 |
| Metal Detergents | 0.1-15.0 | 0.2-8.0 |
| Corrosion Inhibitor | 0-5.0 | 0-2.0 |
| Metal dihydrocarbyl dithiophosphate | 0.1-6.0 | 0.5-4.0 |
| Ash-free amine phosphate salt | 0-6.0 | 0.0-4.0 |
| Antifoaming agents | 0-5.0 | 0.001-0.15 |
| Antiwear agents | 0-1.0 | 0-0.8 |
| Pour point depressant | 0.01-5.0 | 0.01-1.5 |
| Viscosity modifier | 0.01-20.00 | 0.25-10.0 |
| Friction modifiers | 0-2.0 | 0.1-1.0 |
| Base oil | Balance | Balance |
| Total | 100 | 100 |

Additional optional additives that may be included in lubricant compositions described herein include, but are not limited to, rust inhibitors, emulsifiers, demulsifiers, and oil-soluble titanium-containing additives.

Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). The use of an additive concentrate may take advantage of the mutual compatibility afforded by the combination of ingredients when in the form of an additive concentrate. Also, the use of a concentrate may reduce blending time and may lessen the possibility of blending errors.

The present disclosure provides novel lubricating oil blends specifically formulated for use as automotive engine lubricants. Embodiments of the present disclosure may provide lubricating oils suitable for engine applications that provide improvements in one or more of the following characteristics: antioxidancy, antiwear performance, rust inhibition, fuel economy, water tolerance, air entrainment, seal protection, and foam reducing properties.

In order to demonstrate the benefits and advantages of lubricant compositions according to the disclosure, the following non-limiting examples are provided. Dispersant (c) was made according to the following example.

EXAMPLE 1

The set-up requires a 1 L 4-neck flask with agitator, addition funnel, temperature probe, temperature controller, heating mantle, Dean-Stark trap, and a condenser. The flask was charged with 2100 $M_n$ polyisobutylene succinic anhydride (PIBSA) (195.0 g; 0.135 mole) and heated to 160° C. under a nitrogen blanket. Polyethylene amine mixture (21.17 g; 0.112 mole) was added drop-wise over 30 min. The reaction mixture was allowed to stir for 4 hours and then was vacuum stripped for 1 hour at 711 mm Hg. Process oil (172.0 g) was added and the mixture was stirred for 15 minutes. 1,8-Naphthalic anhydride (13.39 g; 0.068 mole) was added in one portion at 160° C. The reaction mixture was heated to 165° C. and allowed to stir for 4 hours. Vacuum was applied (711 mm Hg) for 1 hour to remove any residual water. The reaction product was pressure filtered over Hiflow Super Cel Celite to yield 364 g of a dark brown viscous liquid (% N, 1.75; TBN, 36.0).

A 500 mL flask was charged with the foregoing reaction product (200.0 g; 0.102 mole) and heated to 160° C. under a nitrogen blanket. Maleic anhydride (4.48 g; 0.045 mole) was added in one portion. The reaction mixture was allowed to stir for 4 hours and then was vacuum stripped for 1 hour at 711 mm Hg. Process oil (4.48 g) was added and the mixture was stirred for 15 min. The reaction product was pressure filtered over Hiflow Super Cel Celite to yield 165 g of a dark brown viscous liquid (% N, 1.67; TBN, 24.1).

Test to Assess Deposit Control and Emulsion Stability

In order to evaluate lubricant formulations according to the disclosure, various dispersant compositions were tested for their ability to reduce engine deposits in a Sequence IIIG engine test and the ability to maintain stable emulsions in the presence of water. In the following examples the following dispersants were used: Dispersant 1 was a conventional boronated succinimide dispersant having a number average molecular weight of from about 1000 to about 1400 Daltons; a nitrogen content of from about 1.5 to about 1.7 wt. %; Dispersant 2 was dispersant (c) as described above having a number average molecular weight of greater than 1800 Daltons and a nitrogen content of about 1.17 wt. %; and Dispersant 3 was a conventional succinimide dispersant having a number average molecular weight of 2100 Daltons and a nitrogen content of about 1.58 wt. %; Dispersant 4 was a conventional succinimide dispersant having a number average molecular weight of about 1300 Daltons and a nitrogen content of about 1.8 wt. %. The weight percent dispersants in the table are on an active ingredient basis. Antioxidant 1 (Antiox. 1) was a conventional diphenylamine antioxidant; Antioxidant 2 (Antiox. 2) was a conventional sulfurized olefin antioxidant; Antioxidant 3 (Antiox. 3) was a conventional phenolic type antioxidant; and the molybdenum additive was a conventional molybdenum amine complex and is shown in terms of ppm by weight molybdenum metal. The weighted piston deposits (WPD) merit rating was determined according to the Sequence IIIG engine test and the emulsion stability was determined according to the E85 emulsion test (ASTM D7563) at 25° C. The results are shown in the following table.

TABLE 3

| Ex. No. | Disp. 1 (wt. %) | Disp. 2 (wt. %) | Disp. 3 (wt. %) | Disp. 4 (wt. %) | Antiox. 1 (wt. %) | Antiox. 2 (wt. %) | Antiox. 3 (wt. %) | Mo (ppmw) | WPD | E85 Emulsion |
|---|---|---|---|---|---|---|---|---|---|---|
| 1 | 1.7 | — | 0.8 | — | 0.8 | 0.6 | — | 82 | 4.04 | Pass |
| 2 | 1.7 | — | 0.8 | — | 0.8 | 0.6 | — | 262 | 4.26 | Fail |
| 3 | 1.7 | — | 0.8 | — | 1.0 | — | 1.2 | 82 | 3.23 | Pass |
| 4 | 1.7 | — | 0.8 | — | 1.0 | — | 1.2 | 262 | 4.57 | Fail |
| 5 | 0.9 | — | 1.6 | — | 0.8 | 0.6 | — | 82 | 4.02 | Pass |
| 6 | 0.9 | — | 1.6 | — | 0.8 | 0.6 | — | 262 | 3.66 | Fail |
| 7 | 0.9 | — | 1.6 | — | 1.0 | — | 1.2 | 82 | 4.15 | Pass |
| 8 | 0.9 | — | 1.6 | — | 1.0 | — | 1.2 | 262 | 3.32 | Fail |
| 9 | 1.7 | 0.8 | — | — | 0.8 | 0.6 | — | 82 | 5.03 | Pass |

TABLE 3-continued

| Ex. No. | Disp. 1 (wt. %) | Disp. 2 (wt. %) | Disp. 3 (wt. %) | Disp. 4 (wt. %) | Antiox. 1 (wt. %) | Antiox. 2 (wt. %) | Antiox. 3 (wt. %) | Mo (ppmw) | WPD | E85 Emulsion |
|---|---|---|---|---|---|---|---|---|---|---|
| 10 | 1.7 | 0.8 | — | — | 0.8 | 0.6 | — | 262 | 5.47 | Pass |
| 11 | 1.7 | 0.8 | — | — | 1.0 | — | 1.2 | 82 | 4.83 | Pass |
| 12 | 1.7 | 0.8 | — | — | 1.0 | — | 1.2 | 262 | 5.12 | Pass |
| 13 | 1.7 | 0.8 | — | — | 0.8 | 0.6 | — | 295 | — | Pass |
| 14 | 1.7 | 0.8 | — | — | 0.8 | 0.6 | — | 328 | — | Fail |
| 15 | — | 0.8 | — | 1.7 | 0.8 | 0.6 | — | 82 | — | Pass |
| 16 | — | 0.8 | — | 1.7 | 0.8 | 0.6 | — | 295 | — | Fail |

As shown by the foregoing results, the lubricant compositions of Examples 9-12 not only exhibited superior performance in the Sequence IIIG engine test compared to the dispersant compositions of Examples 1-8, but the lubricant compositions of Examples 9-12 also exhibited improved emulsion stability at the higher treat rates of molybdenum additive. By contrast, Examples 15 and 16 contained a non-boronated succinimide dispersant instead of a boronated dispersant in combination with Dispersant 2. When Dispersant 2 and the non-boronated dispersant were used, the lubricant composition did not pass the emulsion test with 295 ppm molybdenum. From Examples 13 and 14, it appears that the upper limit of the molybdenum treat rate is about 300 ppm molybdenum with the dispersant mixture. Above about 300 ppm molybdenum (Example 14), the lubricant composition fails the emulsion test.

At numerous places throughout this specification, reference has been made to a number of U.S. Patents. All such cited documents are expressly incorporated in full into this disclosure as if fully set forth herein.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the invention being indicated by the following claims.

The foregoing embodiments are susceptible to considerable variation in practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A lubricant additive composition comprising:

(a) an organomolybdenum compound contributing from about 20 to no greater than 300 ppm by weight molybdenum to a lubricant composition based on a total weight of the lubricant composition containing the additive composition;

(b) from about 0.9 to about 2.2 weight % of a boronated hydrocarbyl substituted succinimide dispersant based on a total weight of a lubricant composition containing the additive composition; and (c) from about 0.4 to about 1.7 weight % of a reaction product of (i) a hydrocarbyl-dicarboxylic acid or anhydride, (ii) a polyamine, (iii) a dicarboxyl-containing fused aromatic compound, and (iv) a non-aromatic dicarboxylic acid or anhydride based on the total weight of the lubricant composition containing the additive composition, wherein the hydocarbyl group of the hydrocarbyl-dicarboxylic acid or anhydride has a number average molecular weight of greater than 1800 Daltons as determined by gel permeation chromatography.

2. The additive composition of claim 1, wherein component (iii) comprises 1,8-naphthalic anhydride.

3. The additive composition of claim 1, wherein the hydrocarbyl substituent of component (b) is derived from a polyolefin having a number average molecular weight ranging from about 1000 to about 1600 Daltons as determined by gel permeation chromatography.

4. The additive composition of claim 1, wherein from about 0.25 to about 1.5 moles of the fused aromatic compound are reacted per mole of component (ii).

5. The additive composition of claim 1, wherein component (i) comprises a polyalkenyl-substituted succinic acid or anhydride.

6. The additive composition of claim 5, wherein component (i) comprises a polyisobutenyl succinic acid or anhydride, component (iii) comprises 1,8-naphthalic anhydride, and component (iv) comprises maleic anhydride.

7. The additive composition of claim 6, wherein the polyisobutenyl group is derived from polyisobutylene having greater than 50 mole percent terminal vinylidene content.

8. The additive composition of claim 1, wherein from about 0.25 to about 1.5 moles of component (iv) are reacted per mole of component (ii).

9. A lubricant composition comprising the additive composition of claim 1.

10. The lubricant composition of claim 9, further comprising one or more of the members of the group selected from detergents, non-metallic friction modifiers, antioxidants, rust inhibitors, viscosity index improvers, emulsifiers, demulsifiers, corrosion inhibitors, antiwear agents, metal dihydrocarbyl dithiophosphates, ash-free amine phosphate salts, antifoam agents, and pour point depressants.

11. The lubricant composition of claim 9, further comprising an oil-soluble titanium-containing additive.

12. A method for controlling piston depositions in an engine, comprising lubricating the engine with a lubricant composition comprising a base oil of lubricating viscosity and a lubricant additive composition comprising:

(a) an organomolybdenum compound contributing from about 20 to no greater than 300 ppm by weight of molybdenum to the lubricant composition based on a total weight of the lubricant composition;

(b) from about 0.9 to about 2.2 weight % of a boronated hydrocarbyl substituted succinimide dispersant based on a total weight of the lubricant composition; and (c) from about 0.4 to about 1.7 weight % of a reaction product of (i) a hydrocarbyl-dicarboxylic acid or anhydride, (ii) a polyamine, (iii) a dicarboxyl-containing fused aromatic compound, and (iv) a non-aromatic dicarboxylic acid or anhydride based on a total weight of the lubricant composition, wherein the hydocarbyl group of the hydrocarbyl-dicarboxylic acid or anhydride has a number average molecular weight of greater than 1800 Daltons as determined by gel permeation chromatography.

13. The method of claim 12, wherein the hydrocarbyl substituent of component (b) is derived from a polyolefin having a number average molecular weight ranging from about 1000 to about 1600 Daltons as determined by gel permeation chromatography.

14. The method of claim 12, wherein component (c)(iii) comprises 1,8-naphthalic anhydride.

15. The method of claim 12, wherein component (c)(i) comprises maleic anhydride.

16. The method of claim 12, wherein component (c)(i) comprises a polyisobutenyl succinic acid or anhydride and component (c)(ii) comprises a polyamine containing from 3 to 5 nitrogen atoms.

17. The method of claim 12, wherein a mole ratio of component (c)(iii) reacted with components (c)(i) and (c)(ii) ranges from about 0.25 to about 1.5 and a mole ratio of component (c)(iv) reacted with components (c)(i) and (c)(ii) ranges from about 0.25 to about 1.5.

18. The method of claim 12, wherein the lubricant composition further comprises one or more of the members of the group selected from detergents, dispersants, friction modifiers, antioxidants, rust inhibitors, viscosity index improvers, emulsifiers, demulsifiers, corrosion inhibitors, antiwear agents, metal dihydrocarbyl dithiophosphates, ash-free amine phosphate salts, antifoam agents, and pour point depressants.

19. The method of claim 12, wherein the lubricant composition further comprises an oil-soluble titanium-containing additive.

20. A method for maintaining an emulsion stability of an engine lubricant composition, comprising lubricating an engine with a lubricant composition comprising a base oil of lubricating viscosity and a lubricant additive composition comprising:

(a) an organomolybdenum compound contributing from about 20 to no greater than 300 ppm by weight of molybdenum to the lubricant composition based on a total weight of the lubricant composition;

(b) from about 0.9 to about 2.2 weight % of a boronated hydrocarbyl substituted succinimide dispersant based on a total weight of the lubricant composition; and (c) from about 0.4 to about 1.7 weight % of a reaction product of (i) a hydrocarbyl-dicarboxylic acid or anhydride, (ii) a polyamine, (iii) a dicarboxyl-containing fused aromatic compound, and (iv) a non-aromatic dicarboxylic acid or anhydride based on a total weight of the lubricant composition, wherein the hydocarbyl group of the hydrocarbyl-dicarboxylic acid or anhydride has a number average molecular weight of greater than 1800 Daltons as determined by gel permeation chromatography.

21. The method of claim 20, wherein the hydrocarbyl group of component (c)(i) comprises a polyisobutenyl group derived from polyisobutene having greater than 50 mole percent terminal vinylidene content.

* * * * *